US007605810B2

(12) United States Patent
Shin

(10) Patent No.: US 7,605,810 B2
(45) **Date of Patent: *Oct. 20, 2009**

(54) DEMULTIPLEXER AND DISPLAY DEVICE USING THE SAME

(75) Inventor: Dong-Yong Shin, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 993 days.

This patent is subject to a terminal disclaimer.

(21) Appl. No.: 10/972,276

(22) Filed: Oct. 22, 2004

(65) Prior Publication Data

US 2005/0116918 A1 Jun. 2, 2005

(30) Foreign Application Priority Data

Nov. 29, 2003 (KR) ..... 10-2003-0086113

(51) Int. Cl.
*G09G 3/36* (2006.01)

(52) U.S. Cl. ..... 345/214; 345/87; 345/98; 345/204; 345/205; 345/210; 315/169.3

(58) Field of Classification Search ..... 345/55–111, 345/204, 205, 214; 315/169.3
See application file for complete search history.

(56) References Cited

U.S. PATENT DOCUMENTS 6,097,362 A 8/2000 Kim
6,963,336 B2 11/2005 Kimura
7,180,497 B2 * 2/2007 Lee et al. ..... 345/98
7,193,593 B2 * 3/2007 Koyama et al. ..... 345/87
7,468,718 B2 * 12/2008 Shin ..... 345/98
2006/0119552 A1 6/2006 Yumoto

FOREIGN PATENT DOCUMENTS

| | | | |
|---|---|---|---|
| CN | 1432989 | A | 7/2003 |
| GB | 2 384 102 | A | 7/2003 |
| JP | 2-306293 | | 12/1990 |
| JP | 6-118913 | | 4/1994 |
| JP | 11-133949 | | 5/1999 |
| WO | WO 02/39420 | A1 | 5/2002 |
| WO | WO 03/038797 | A1 | 5/2003 |

OTHER PUBLICATIONS

Patent Abstracts of Japan, Publication No. 02-306293, dated Dec. 19, 1990, in the name of Toshikazu Shimizu.
Patent Abstracts of Japan, Publication No. 06-118913, dated Apr. 28, 1994, in th name of Hideki Sashita.

* cited by examiner

*Primary Examiner*—Bipin Shalwala
*Assistant Examiner*—Vince E Kovalick
(74) *Attorney, Agent, or Firm*—Christie, Parker & Hale, LLP

(57) ABSTRACT

A display device including a plurality of data lines for transmitting a data current corresponding to image signals, a plurality of scan lines for selecting select signals, and a plurality of pixel circuits coupled to the data lines and the scan lines. The display device includes a data driver for supplying the data current corresponding to the image signals, and a demultiplexer including first and second sample/hold circuit groups having input terminals coupled to the data driver. Each of the sample/hold circuit groups includes at least two sample/hold circuits. The display device also includes a switch unit for switching between output terminals of the first and second sample/hold circuit groups and the data lines, and a scan driver for supplying the select signals to the scan lines.

35 Claims, 15 Drawing Sheets

DEMULTIPLEXER AND DISPLAY DEVICE USING THE SAME

CROSS REFERENCE TO RELATED APPLICATION

This application claims priority to and the benefit of Korea Patent Application No. 10-2003-0086113 filed on Nov. 29, 2003 in the Korean Intellectual Property Office, the entire content of which is incorporated herein by reference.

BACKGROUND OF THE INVENTION (a) Field of the Invention

The present invention relates to a display device. More specifically, the present invention relates to a demultiplexer for demultiplexing the data current in a display device.

(b) Description of the Related Art

FIG. 1 shows an active matrix organic light emitting diode (AMOLED) display device as an example of a current driven display device which needs current demultiplexing.

The current driven display device includes an organic electroluminescent (EL) display panel 100, a data driver 200 for providing a data current, a current demultiplexer 300 for performing 1:N demultiplexing on the data current, and scan drivers 400 and 500 for sequentially selecting a plurality of scan lines.

A predetermined data current is applied to pixels 10 coupled to scan lines selected by the scan drivers 400 and 500, and the pixels 10 display colors corresponding to the data current. A current demultiplex unit 300 is used so as to reduce the number of integrated circuits (ICs) of the data driver. That is, the current provided by the data driver 200 is 1:N-demultiplexed by the demultiplex unit 300, and is applied to the pixels corresponding to the N data lines data[1] to data[n]. Usage of the demultiplex unit 300 reduces the number of ICs necessary for the data driver and saves purchase costs.

FIG. 2 shows a conventional analog switch for a demultiplexer.

The 1:2 demultiplexer shown in FIG. 2 alternately switches the switches S1 and S2 to thereby output the data current to two data lines. A long time is required to program the data to the pixels 10 in order to realize high resolution in the current driven panel. When such conventional demultiplexing scheme is used to reduce the number of ICs of the data driver, however, the data programming time needs to be reduced since the data are to be programmed to the pixels each time the switches are alternately switched. Therefore, the conventional demultiplexer is not suitable for high-resolution display devices.

SUMMARY OF THE INVENTION

In exemplary embodiments according to the present invention, is provided a demultiplexing device and method for reducing the number of ICs of the data driver without reducing the data programming time.

Further, in exemplary embodiments according to the present invention, is provided a demultiplexing device and method appropriate for high-resolution display devices.

In a first aspect of the present invention, is provided a display device including a plurality of data lines for transmitting a data current corresponding to image signals, a plurality of scan lines for transmitting select signals, and a plurality of pixel circuits coupled to the data lines and the scan lines. The display device includes: a data driver for supplying the data current corresponding to the image signals, and a demultiplexer including first and second sample/hold circuit groups having input terminals coupled to the data driver. Each said sample/hold circuit group includes at least two sample/hold circuits. The display device also includes a switch unit for switching between output terminals of the first and second sample/hold circuit groups and the data lines, and a scan driver for supplying the select signals to the scan lines. One of the sample/hold circuits of the first sample/hold circuit group samples the data current during at least a part of a period in which another one of the sample/hold circuits of the first sample/hold circuit group outputs a current to the switch unit. One of the sample/hold circuits of the second sample/hold circuit group samples the data current during at least a part of a period in which another one of the sample/hold circuits of the second sample/hold circuit group outputs a current to the switch unit.

In a second aspect of the present invention, is provided a display device including a plurality of data lines for transmitting a data current corresponding to image signals, a plurality of scan lines for transmitting select signals, and a plurality of pixel circuits coupled to the data lines and the scan lines. The display device includes: a data driver for supplying the data current corresponding to the image signal, and a demultiplexer having an input terminal coupled to the data driver. The demultiplexer demultiplexes the data current to output as a demultiplexed data current. The display device also includes a switch unit for switching between an output terminal of the demultiplexer and the data lines, and a scan driver for supplying the select signals to the scan lines. Operations of the switch unit are repeated for each predetermined period.

In a third aspect of the present invention, is provided a display device including a plurality of data lines for transmitting a data current corresponding to image signals, a plurality of scan lines for transmitting select signals, and a plurality of pixel circuits coupled to the data lines and the scan lines. The display device includes: a data driver for supplying the data current corresponding to the image signals, and a demultiplexer including first and second sample/hold circuit groups. Each of the first and second sample/hold circuit groups has an input terminal coupled to a data driver, and demultiplexes the data current to output as demultiplexed currents. The display device also includes a switch unit for switching between output terminals of the first and second sample/hold circuit groups and the data lines, and a scan driver for supplying the select signals to the scan lines. The first sample/hold circuit group includes first and third sample/hold circuits each having an input terminal and an output terminal, wherein the input terminals are coupled with each other, and the output terminals are coupled with each other. The second sample/hold circuit group includes second and fourth sample/hold circuits each having an input terminal and an output terminal, wherein the input terminals are coupled with each other, and the output terminals are coupled with each other.

In a fourth aspect of the present invention, a demultiplexer for programming a time-divided data current, which is input by a data driver, to at least two signal lines, is provided. The demultiplexer includes: first and second sample/hold circuit groups each having an input terminal coupled to a data driver, and demultiplexing the data current to output as demultiplexed currents, and a switch unit for switching between output terminals of the first and second sample/hold circuit groups and the signal lines. The first sample/hold circuit group includes first and third sample/hold circuits each having an input terminal and an output terminal, wherein the input terminals are coupled with each other, and the output terminals are coupled with each other. The second sample/hold circuit group includes second and fourth sample/hold circuits each having an input terminal and an output terminal, wherein the input terminals are coupled with each other, and the output terminals are coupled with each other.

In a fifth aspect of the present invention, a demultiplexing method for outputting a time-divided and sequentially input data current to at least two signal lines, is provided. The method includes: allowing first and second sample/hold circuits to sequentially sample the data current to store as first sampled data in a predetermined order during a first period; allowing the first and second sample/hold circuits to hold a current corresponding to the first sampled data to the signal lines during a second period; allowing third and fourth sample/hold circuits to sample the data current to store as second sampled data during the second period; and allowing the third and fourth sample/hold circuits to hold a current corresponding to the second sampled data to the signal lines during a third period.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
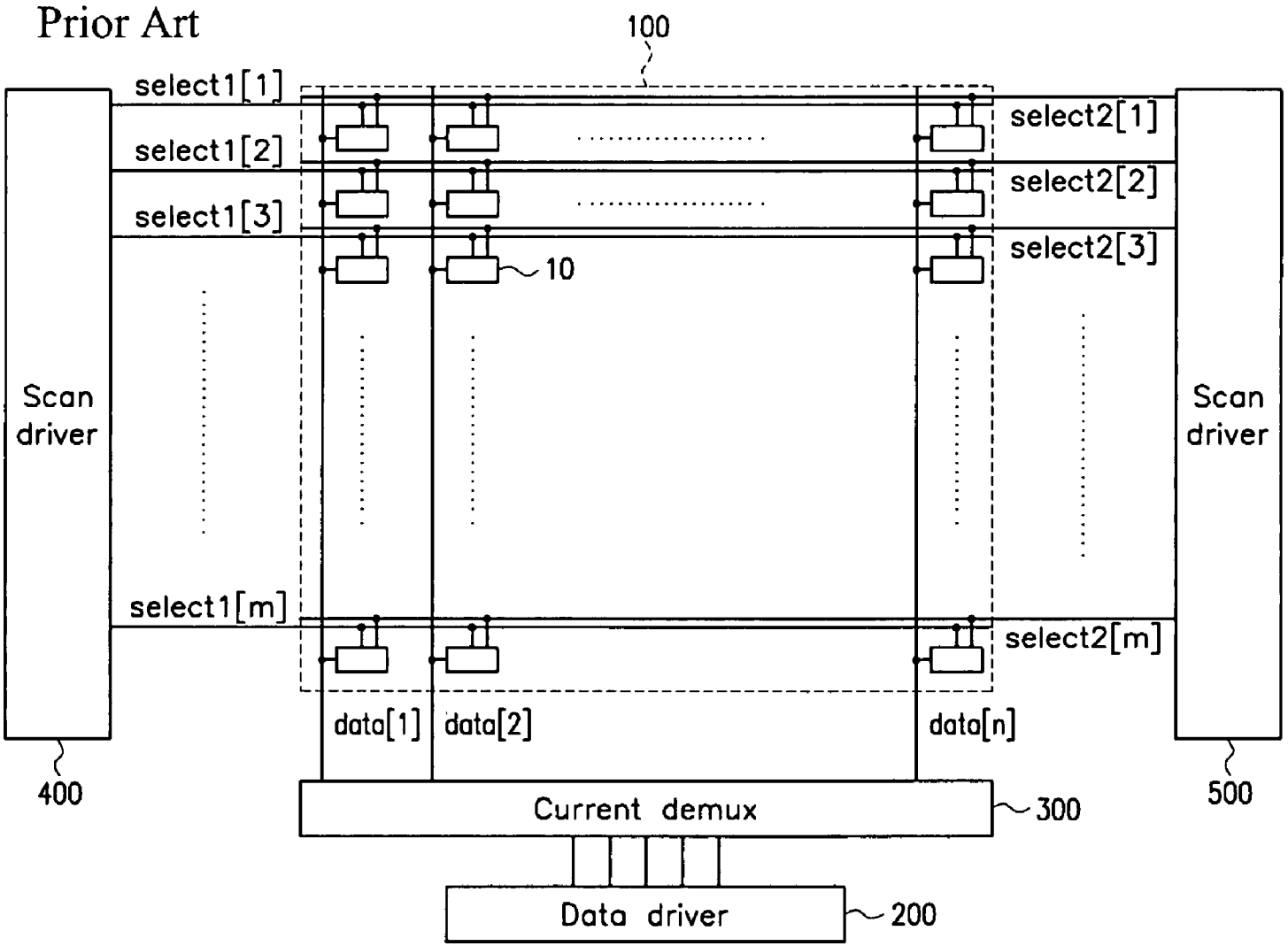
FIG.1 Prior Art
FIG. 1 shows an AMOLED display device as an example of a current driven display device, which may use current demultiplexing according to exemplary embodiments of the present invention.
Figure 2:
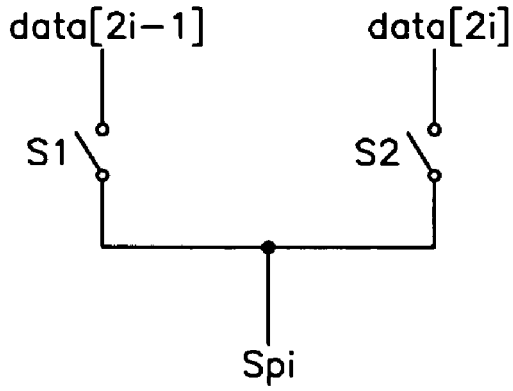
FIG.2 Prior Art
FIG. 2 shows a conventional demultiplexer having analog switches.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive.

The term "couple" or the phrase such as "coupling one thing to another" refer to both directly coupling a first one to a second one and coupling the first one to the second one through a third one which is provided therebetween. To clarify the present invention, parts which are not described in the specification may have been omitted, and like elements are designated by like reference numerals.

Figure 3:
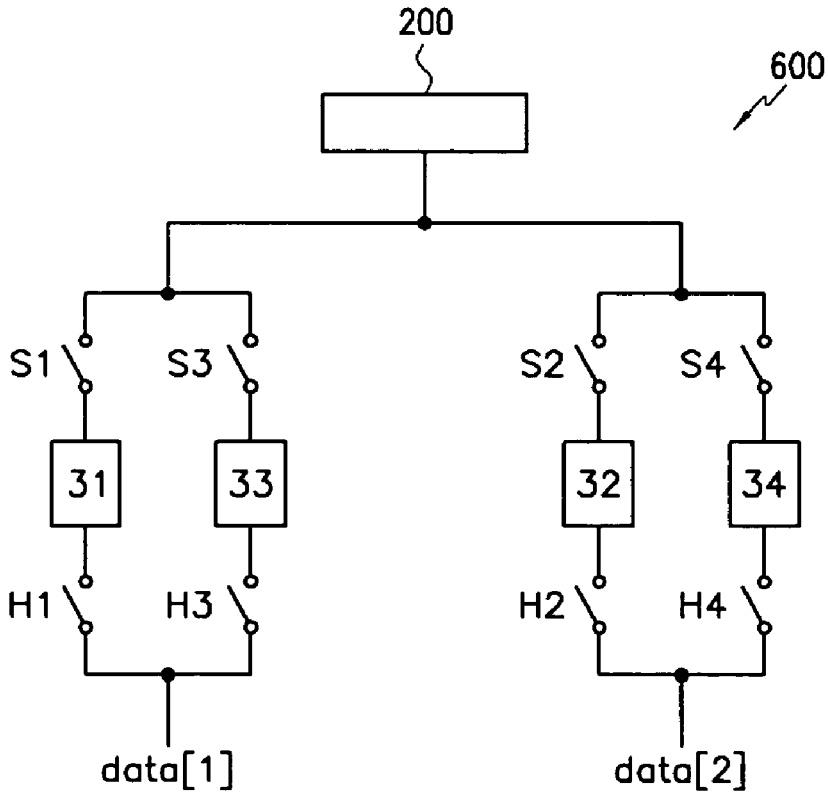
FIG. 3 shows a conceptual block diagram of a demultiplexer according to a first exemplary embodiment of the present invention.

FIG. 3 shows a conceptual block diagram of a demultiplexer 600 according to a first exemplary embodiment of the present invention. By way of example, the demultiplexer 600 may be used as the demultiplexer 300 of FIG. 1.

As shown, the demultiplexer 600 uses four sample/hold circuits which include data storage units 31, 32, 33, and 34; sampling switches S1, S2, S3, and S4; and holding switches H1, H2, H3, and H4. The data storage units 31, 32, 33, and 34 are coupled to the data driver 200 through the sampling switches S1, S2, S3, and S4, respectively, and coupled to the data lines data[1] and data[2] through the holding switches H1, H2, H3, and H4, respectively.

The terminologies of "to sample" and "to hold" used in the specification will now be defined.

The sample/hold operation includes an operation for sampling the current flowing through the input terminal and writing it in the data storage units in the voltage format, a state for maintaining the written data and standing by since the input switches and the output switches are turned off, and an operation for supplying ("holding") the current of the data lines by using the values corresponding to the written data. The above-noted stages can be referred to, respectively, as a "sampling" stage, a "standby" stage, and a "holding" stage based on the operations performed therein, for better clarification.

The internal configuration of the sample/hold circuit according to the exemplary embodiment will now be described in detail. Since the four sample/hold circuits used in the demultiplexer 600 are substantially identically realized, one sample/hold circuit will be described hereinafter.

Figure 4A:
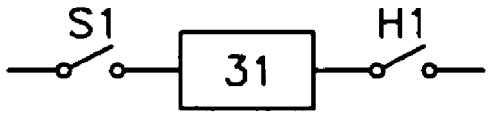
FIG. 4A shows a first sample/hold circuit according to the first exemplary embodiment of the present invention.
Figure 4B:
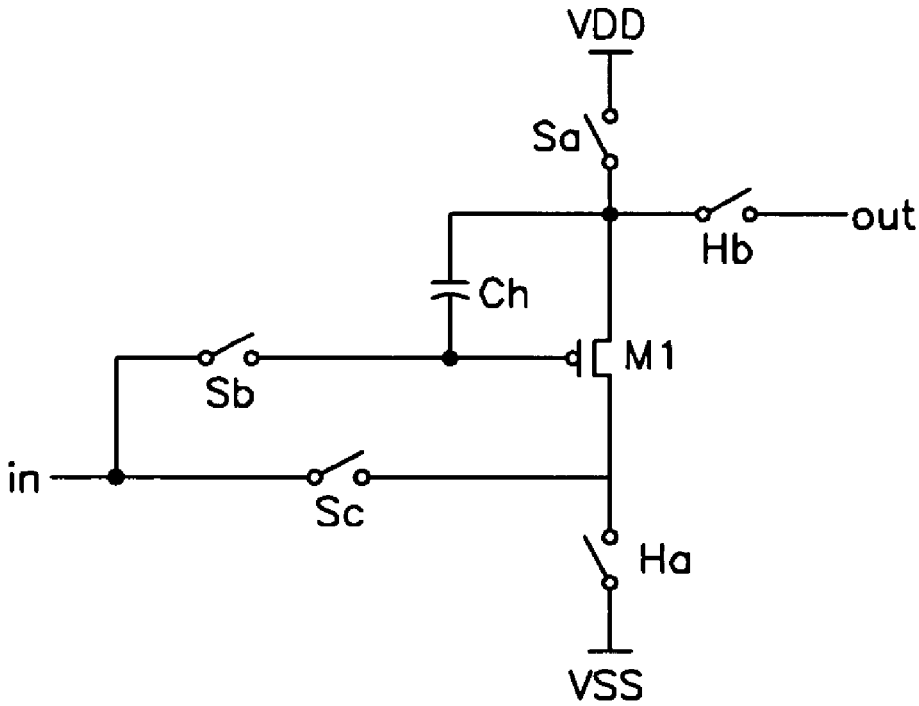
FIG. 4B shows an equivalent circuit of the circuit shown in FIG. 4A.

FIG. 4A shows a first sample/hold circuit according to a first exemplary embodiment, and FIG. 4B shows an equivalent circuit of the circuit shown in FIG. 4A.

The first sample/hold circuit includes a transistor M1, a capacitor Ch, sampling switches Sa, Sb, and Sc, and holding switches Ha and Hb, as shown in FIG. 4B.

The sampling switches Sa, Sb, and Sc represent the switch S1 of FIG. 4A, and they are turned on/off by substantially identical control signals. The holding switches Ha and Hb respectively represent the switch H1 of FIG. 4A, and they are turned on/off by substantially identical control signals.

The sampling switch Sa is coupled between a power supply source VDD and a source of the transistor M1, and the holding switch Ha is coupled between a power supply source VSS and a drain of the transistor M1. A first terminal of the sampling switch Sb is coupled to a gate of the transistor M1, a second terminal thereof is coupled to a first terminal of the sampling switch Sc, and a second terminal of the sampling switch Sc is coupled to the drain of the transistor M1. Hence, the transistor M1 is diode-connected when the sampling switches Sb and Sc are both turned on.

An operation of the first sample/hold circuit will now be described in reference to FIGS. 3, 4A and 4B.

When the sampling switches Sa, Sb, and Sc are turned on and the holding switches Ha and Hb are turned off, the gate and the source of the transistor M1 are coupled to thus form a diode connection, and the current flows to the data driver 200 through the transistor M1 from the power supply source VDD. The capacitor Ch is charged with a gate-source voltage which corresponds to the current flowing to the transistor M1, and the first sample/hold circuit performs a sampling operation of the data.

When the sampling switches Sa, Sb, and Sc and the holding switches Ha and Hb are turned off, the first sample/hold circuit enters the standby stage while another sample/hold circuit of the demultiplexer 600 holds the data to the data lines.

When the sampling switches Sa, Sb, and Sc are turned off and the holding switches Ha and Hb are turned on, the current which corresponds to the gate-source voltage charged in the capacitor Ch is maintained to flow to the drain from the source of the transistor M1. In this instance, the first sample/hold circuit performs a data programming operation, and holds the data through the data lines.

FIG. 4B illustrates the transistor M1 which is realized with a p channel transistor. In other embodiments, however, the transistor M1 can be realized with any suitable active element which has a first electrode, a second electrode, and a third electrode, and controls the current flowing to the third electrode according to a voltage applied to the first and second electrodes.

FIG. 4B illustrates a single sample/hold circuit, but the scope of the present invention is not restricted to specific sample/hold circuits, and the scope thereof is applicable to demultiplexers which perform the demultiplexing operation to be subsequently described using the sample/hold circuits.

Figure 5:
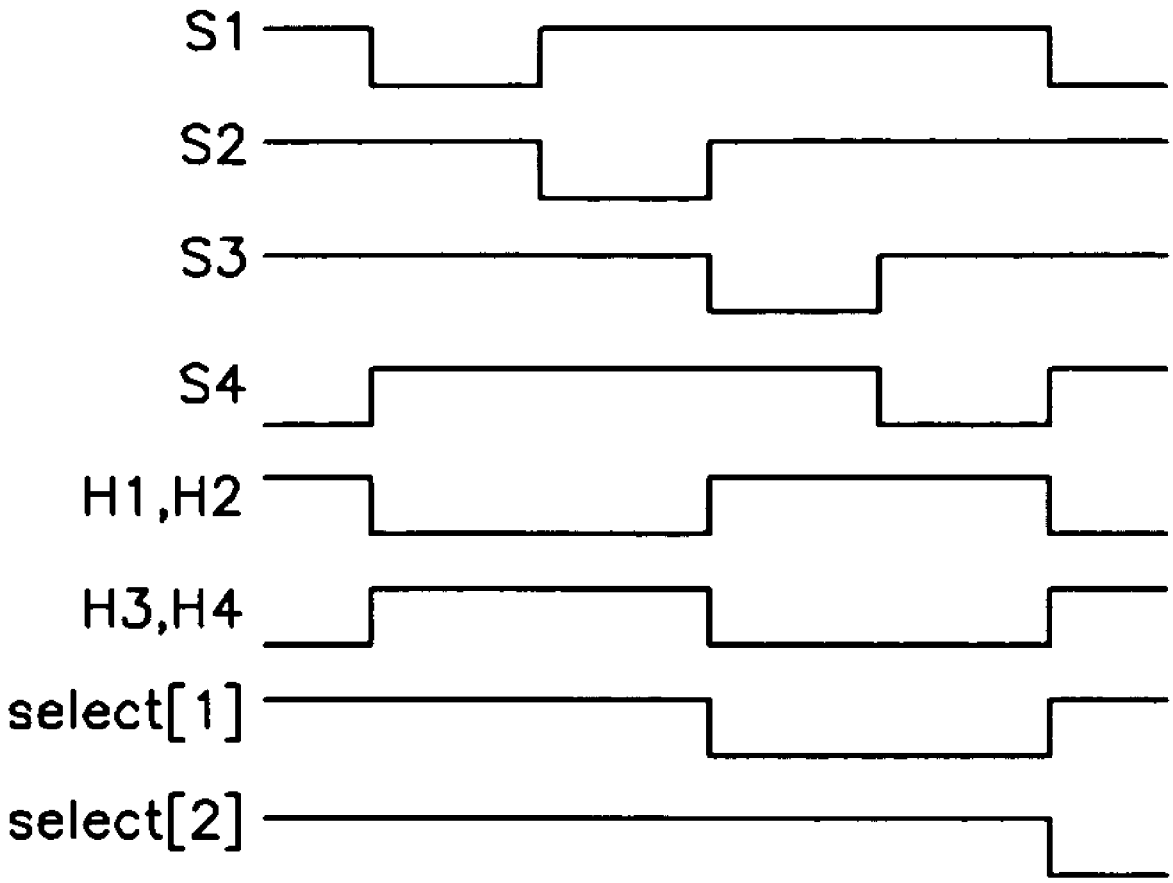
FIG. 5 shows a waveform of a control signal applied to a demultiplexer according to the first exemplary embodiment of the present invention.

Referring to FIG. 5, an operation of the demultiplexer 600 according to the first exemplary embodiment of the present invention will now be described.

FIG. 5 shows a waveform of a control signal applied to the demultiplexer 600 according to the first exemplary embodiment of the present invention. It is assumed below that the sampling switches S1, S2, S3, and S4 are turned on when the applied control signal is low, and the holding switches H1, H2, H3, and H4 are turned on when the applied control signal is high.

When the sampling switches S1 and S2 are sequentially turned on, the data storage units 31 and 32 input the data currents and perform a sampling operation. Further, when the sampling switches S3 and S4 are sequentially turned on, the data storage units 33 and 34 perform a sampling operation. At the same time, since a select signal Select[1] is applied and the holding switches H1 and H2 are turned on, the currents sampled by the data storage units 31 and 32 are held to the data lines data[1] and data[2] and are programmed to the pixels.

When the select signal Select[2] is applied and the holding switches H3 and H4 are turned on (not illustrated), the currents sampled by the data storage units 33 and 34 are held to the data lines data[1] and data[2] and are programmed to the pixels.

The above-noted operation is repeatedly performed, and the demultiplexer 600 demultiplexes the data current output from the data driver 200 and provides demultiplexed currents to the data lines data[1] and data[2].

The demultiplexer 600 according to the first exemplary embodiment allows an increased data programming time when two sample/hold circuits sequentially sample the data currents provided from the data driver 200 while the other two sample/hold circuits hold the data through the data lines.

However, when the demultiplexer 600 according to the first exemplary embodiment is actually used, repeated spot patterns may be found on the display panel 100 because of characteristic differences of the four sample/hold circuits included in the demultiplexer 600 or the orders for sampling the data currents. In detail, the reason is that the held currents are not the same even when the four sample/hold circuits sample the identical data currents.

To address this problem, in other exemplary embodiments, the four sample/hold circuits supply the data currents to the respective pixels the same number of times, and an average of the output currents of the four sample/hold circuits may be supplied to the pixels.

The average of the output currents of the four sample/hold circuits is supplied to the pixels in a second exemplary embodiment by repeating four frames which have different corresponding relations between the four sample/hold circuits and the pixels which receive the data currents from the four circuits.

Referring to FIGS. 6 to 10, a demultiplexer 700 according to the second exemplary embodiment will be described in detail.

Figure 6:
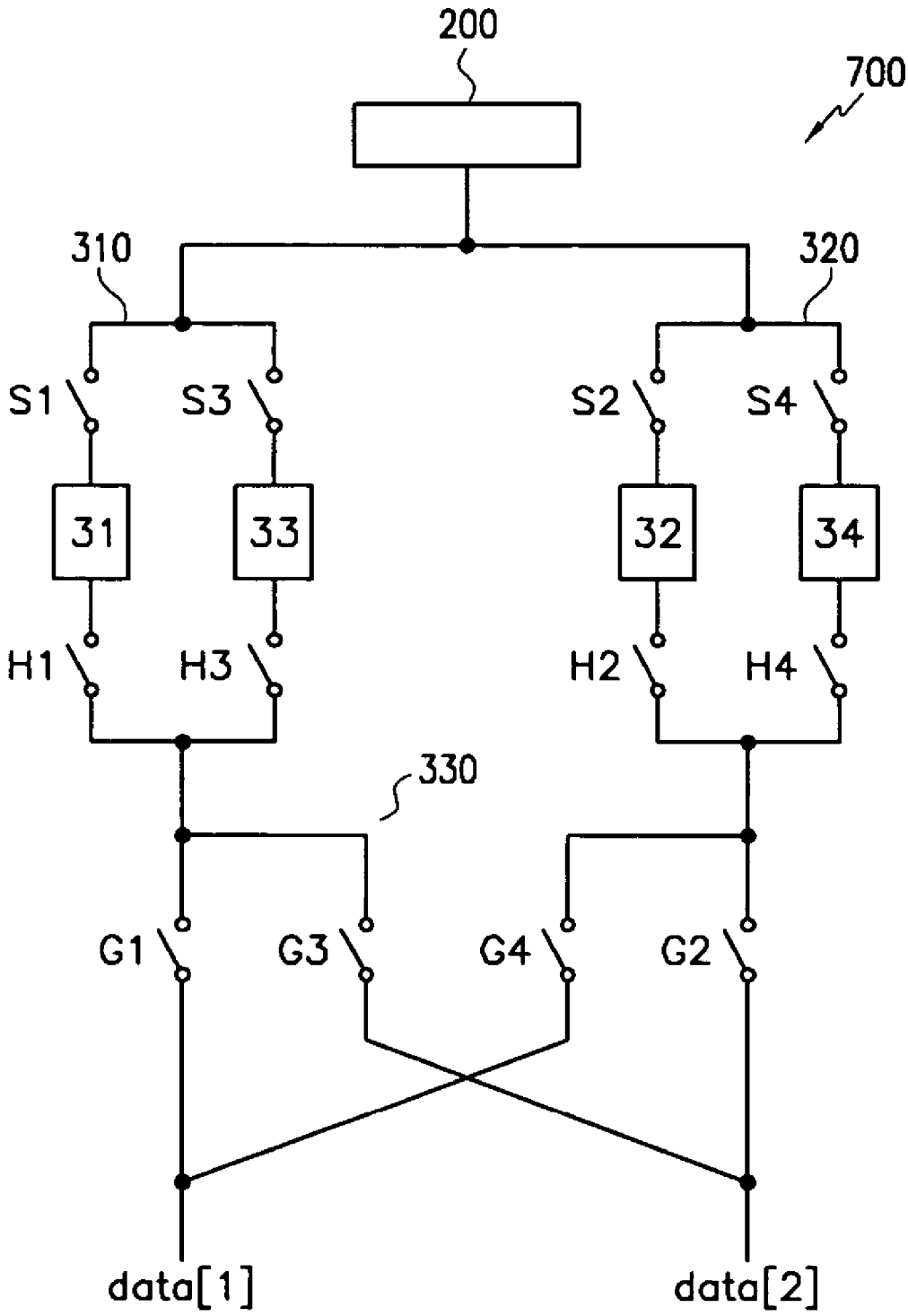
FIG. 6 shows a demultiplexer according to a second exemplary embodiment of the present invention.

FIG. 6 shows the demultiplexer 700 according to the second exemplary embodiment of the present invention. By way of example, the demultiplexer 700 may be used as the demultiplexer 300 of FIG. 1.

As shown, the demultiplexer 700 includes a first sample/hold circuit group 310, a second sample/hold circuit group 320, and a switch unit 330. The first sample/hold circuit group 310 includes first (1st) and third (3rd) sample/hold circuits including, respectively, the data storage unit 31 and the switches S1, H1 and the data storage unit 33 and the switches S3, H3. The second sample/hold circuit group 320 includes second (2nd) and fourth (4th) sample/hold circuits including, respectively, the data storage unit 32 and the switches S2, H2 and the data storage unit 34 and the switches S4, H4.

The first and second sample/hold circuit groups 310 and 320 demultiplex the data current provided from the data driver 200 and output results, and the switch unit 330 switches between output terminals of the first and second sample/hold circuit groups 310 and 320 and the data lines data [1] and data[2].

In more detail, the switch unit 330 includes four switches G1, G2, G3 and G4. The switch G1 is coupled between the holding switches H1, H3 and the data line data[1], and the switch G3 is coupled between the holding switches H1, H3 and the data line data[2]. Further, the switch G2 is coupled between the holding switches H2, H4 and the data line data [2], and the switch G4 is coupled between the holding switches H2, H4 and the data line data[1]. This way, the switch unit 330 can provide holding current from each of the first and second sample/hold circuit groups 310 and 320 to either the data line data[1] or to the data line data[2] depending on the state of the switches G1, G2, G3 and G4.

Figure 7:
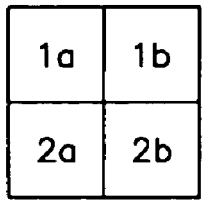
FIG. 7 shows a conceptualized view of a pixel group coupled to the demultiplexer shown in FIG. 6.
Figure 8:
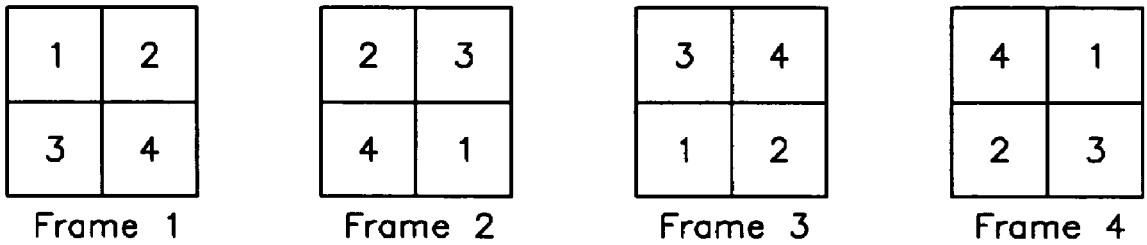
FIG. 8 shows numbers corresponding to the sample/hold circuits that are used for programming currents to the pixels of FIG. 7 in first to fourth frames according to the second exemplary embodiment of the present invention.

Referring now to FIGS. 7 to 10, an operation of the demultiplexer 700 according to the second exemplary embodiment will be described in detail. For ease of description, a conceptual view of four pixels 1*a*, 1*b*, 2*a* and 2*b* that are coupled to the data lines data[1] and data[2] and the scan lines Select[1] and Select[2] are illustrated in FIGS. 7 and 8.

FIG. 7 shows, by way of example, a pixel group coupled to the demultiplexer 700, and FIG. 8 shows numbers that correspond to the sample/hold circuits that are used for programming currents to pixels shown in FIG. 7 according to the second exemplary embodiment of the present invention.

Figure 9A:
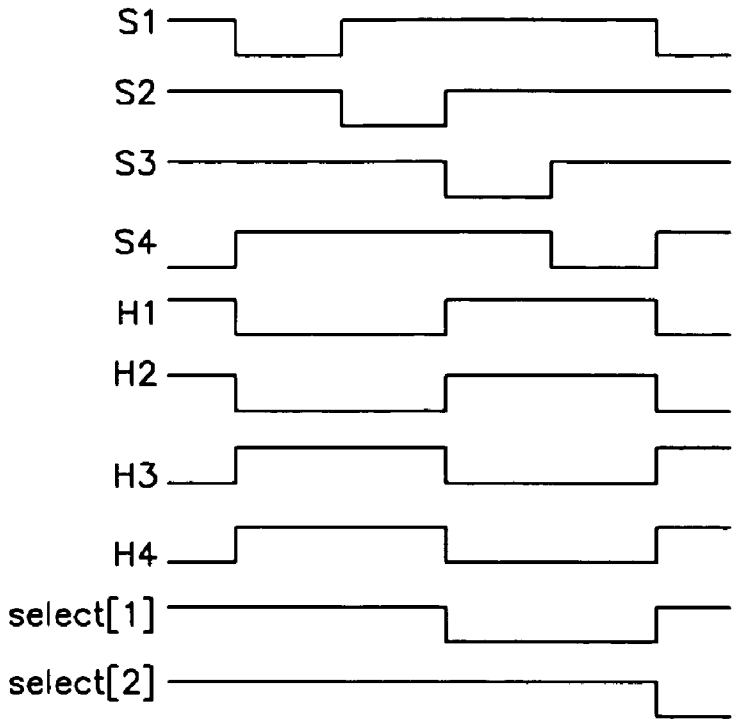
FIGS. 9A to 9D show waveforms of control signals applied to the demultiplexer in the first to fourth frames according to the second exemplary embodiment of the present invention.
Figure 9B:
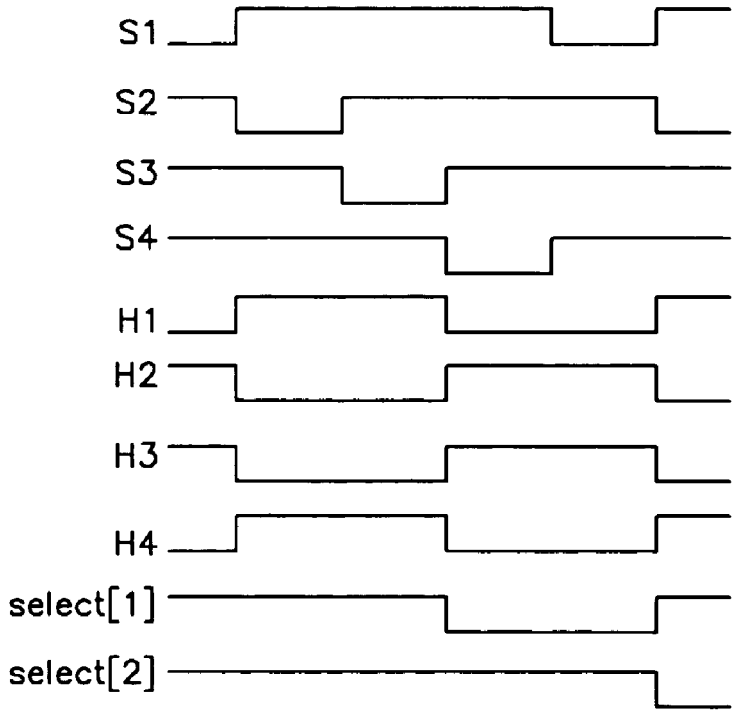
Figure 9C:
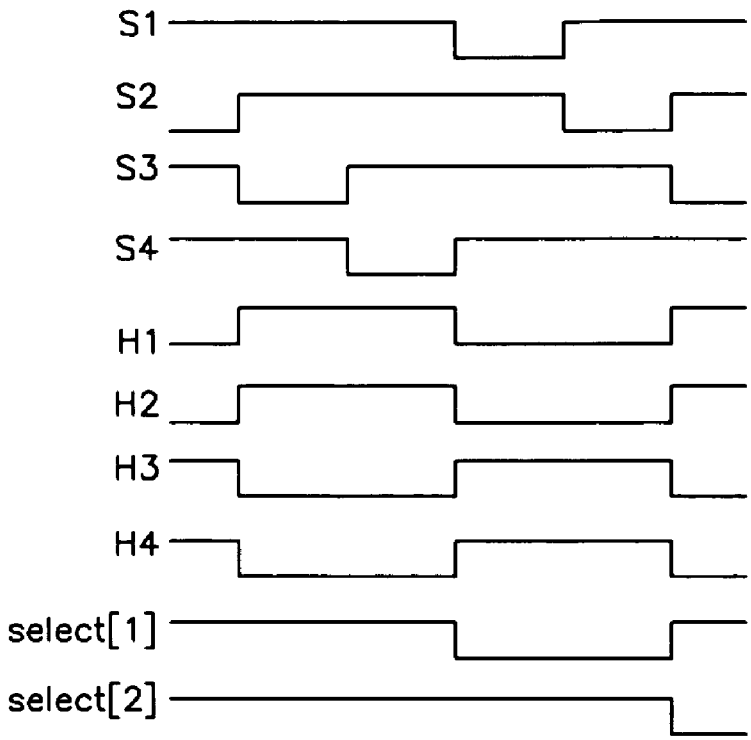
Figure 9D:
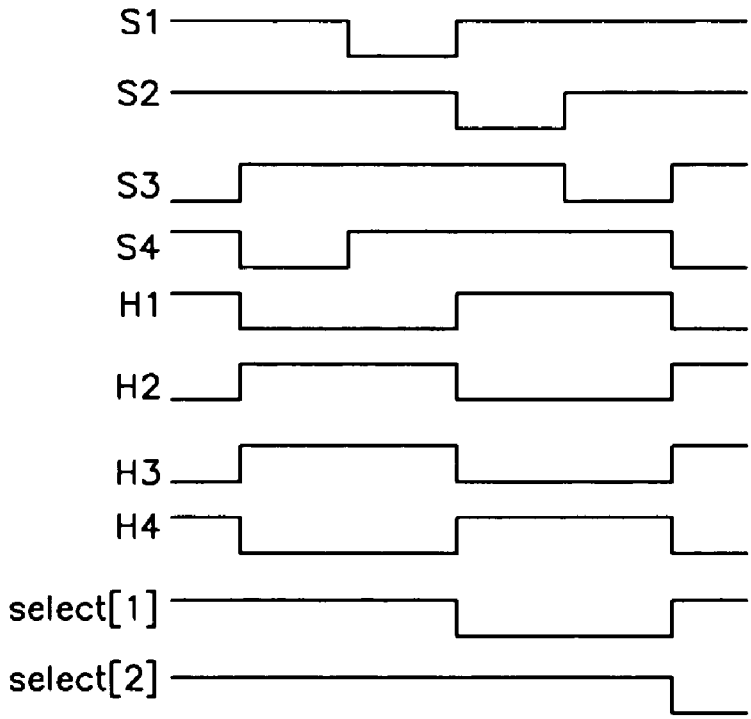
Figure 10:
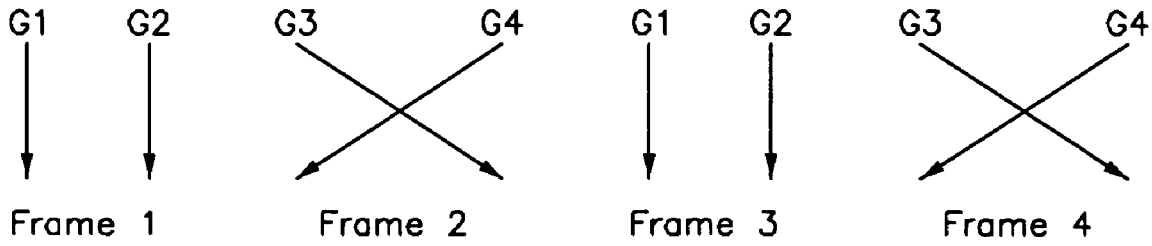
FIG. 10 shows an operation of a switch unit in the first to fourth frames according to the second exemplary embodiment of the present invention.

FIGS. 9A to 9D show waveforms of control signals applied to the demultiplexer 700 in the first to fourth frames, and FIG. 10 shows an operation of the switch unit 330 in the first to fourth frames. FIGS. 9A to 9D illustrate the waveforms of the control signals during programming the current to the pixels 1*a*, 1*b*, 1*c* and 1*d*. In FIG. 10, the switches of the switch unit 330 that are turned on for programming in each frame are indicated.

As shown in FIG. 9A, the sampling switches S1, S2, S3, and S4 are sequentially turned on, and the data storage units 31, 32, 33, and 34 sequentially sample the data currents input by the data driver 200 in the first frame. In this instance, since the data driver 200 outputs the data currents in the order of the data currents to be programmed to the pixels 1*a*, 1*b*, 2*a*, and 2*b*, the data storage units 31, 32, 33, and 34 respectively sample the data currents to be programmed to the pixels 1*a*, 1*b*, 2*a*, and 2*b*.

The holding switches H3 and H4 are turned on while the sampling switches S1 and S2 are turned on, but since this is before the select signal Select[1] is applied, no current is held to the data lines data[1] and data[2].

The select signal Select[1] is applied to the pixels 1*a* and 1*b* and the holding switches H1 and H2 are turned on while the sampling switches S3 and S4 are turned on, and hence, the data storage units 31 and 32 hold the current to the data lines data[1] and data[2] through the switch unit 330.

As can be seen from FIGS. 6 and 10, the switch unit 330 provides the output current of the first sample/hold circuit group 310 to the data line data[1] and provides the output current of the second sample/hold circuit group 320 to the data line data[2] in the first frame.

Therefore, the holding current of the data storage unit 31 is programmed to the pixel 1*a* through the data line data[1], and the holding current of the data storage unit 32 is programmed to the pixel 1*b* through the data line data[2].

After this, an operation (not illustrated) for programming the data current to the pixels 2*a* and 2*b* is performed. In detail, the sampling switches S1 and S2 are sequentially turned on and the data storage units 31 and 32 sample the data currents. At this time, the select signal Select[2] is applied and the holding switches H3 and H4 are turned on so that the holding currents of the data storage units 33 and 34 are programmed to the pixels 2*a* and 2*b* through the data lines data[1] and data[2].

Accordingly, the holding current of the first sample/hold circuit is programmed to the pixel 1*a* of the first frame, the holding current of the second sample/hold circuit is programmed to the pixel 1*b*, the holding current of the third sample/hold circuit is programmed to the pixel 2*a*, and the holding current of the fourth sample/hold circuit is programmed to the pixel 2*b*.

As shown in FIG. 9B, the sampling switches S2, S3, S4, and S1 are sequentially turned on in the second frame.

The data storage units 32 and 33 sequentially perform a sampling operation while the sampling switches S2 and S3 are turned on.

Further, the data storage units 34 and 31 sequentially perform a sampling operation while the sampling switches S4 and S1 are turned on. Also, the select signal Select[1] is applied and the holding switches H2 and H3 are turned on such that the holding currents of the data storage units 32 and 33 are programmed to the data lines data[1] and data[2] through the switch unit 330.

As can be seen from FIGS. 6 and 10, the switch unit 330 provides the output current of the first sample/hold circuit group 310 to the data line data[2] and provides the output current of the second sample/hold circuit group 320 to the data line data[1] in the second frame.

Therefore, the holding current of the data storage unit 32 is programmed to the pixel 1*a* through the data line data[1], and the holding current of the data storage unit 33 is programmed to the pixel 1*b* through the data line data[2].

After this, the select signal Select[2] is applied to the pixels 2*a* and 2*b* and the holding switches H1 and H4 are turned on such that the currents which correspond to the data sampled by the data storage units 31 and 34 are respectively held to the data lines data[2] and data[1] through the switch unit 330.

Therefore, the holding current from the data storage unit 31 is programmed to the pixel 2*b* through the data line data[2], and the holding current from the data storage unit 34 is programmed to the pixel 2*a* through the data line data[1].

Accordingly, the holding current of the second sample/hold circuit is programmed to the pixel 1*a* of the second frame, the holding current of the third sample/hold circuit is programmed to the pixel 1*b*, the holding current of the fourth sample/hold circuit is programmed to the pixel 2*a*, and the holding current of the first sample/hold circuit is programmed to the pixel 2*b*.

The sampling switches S3, S4, S1, and S2 are sequentially turned on and the data storage units 33, 34, 31, and 32 sequentially sample the data current in the third frame.

The select signal Select[1] is applied to the pixels 1*a* and 1*b* while the sampling switches S1 and S2 are turned on. In this instance, the holding switches H3 and H4 are turned on, and the data storage units 33 and 34 hold the currents to the data lines data[1] and data[2] through the switch unit 330.

As can be from FIGS. 6 and 10, the switch unit 330 transmits the output current of the first sample/hold circuit group 310 to the data line data[1] and transmits the output current of the second sample/hold circuit group 320 to the data line data[2] in the third frame.

Therefore, the holding current of the data storage unit 33 is programmed to the pixel 1*a* through the data line data[1], and the holding current of the data storage unit 34 is programmed to the pixel 1*b* through the data line data[2].

After this, when the select signal Select[2] is applied, the currents which correspond to the sampled data are output to the data storage units 31 and 32, the holding current of the data storage unit 31 is programmed to the pixel 2*a* through the switch unit 330, and the holding current of the data storage unit 32 is programmed to the pixel 2*b* through the switch unit 330.

Accordingly, the holding current of the third sample/hold circuit is programmed to the pixel 1*a* of the third frame, the holding current of the fourth sample/hold circuit is programmed to the pixel 1*b*, the holding current of the first sample/hold circuit is programmed to the pixel 2*a*, and the holding current of the second sample/hold circuit is programmed to the pixel 2*b*.

The sampling switches S4, S1, S2, and S3 are sequentially turned on and the data storage units 34, 31, 32, and 33 sequentially sample the data current in the fourth frame.

The data storage units 34 and 31 sequentially perform a sampling operation while the sampling switches S4 and S1 are turned on.

While the sampling switches S2 and S3 are turned on, the data storage units 32 and 33 sequentially perform a sampling operation. Also, the select signal Select[1] is applied to the pixels 1*a* and 1*b* and the holding switches H1 and H4 are turned on such that the holding currents of the data storage units 31 and 34 are programmed, respectively, to the data lines data[2] and data[1] through the switch unit 330.

As can be seen from FIGS. 6 and 10, the switch unit 330 provides the output current of the first sample/hold circuit group 310 to the data line data[2] and provides the output current of the second sample/hold circuit group 320 to the data line data[1] in the fourth frame.

Therefore, the holding current of the data storage unit 31 is programmed to the pixel 1*b* through the data line data[2], and the holding current of the data storage unit 34 is programmed to the pixel 1*a* through the data line data[1].

After this, the select signal Select[2] is applied to the pixels 2*a* and 2*b* and the currents corresponding to the data sampled by the data storage units 32 and 33 are held to the data lines data[1] and data[2] through the switch unit 330. Therefore, the holding current of the data storage unit 32 is programmed to the pixel 2*a*, and the holding current of the data storage unit 33 is programmed to the pixel 2*b*.

Accordingly, the holding current of the fourth sample/hold circuit is programmed to the pixel 1*a* of the fourth frame, the holding current of the first sample/hold circuit is programmed to the pixel 1*b*, the holding current of the second sample/hold circuit is programmed to the pixel 2*a*, and the holding current of the third sample/hold circuit is programmed to the pixel 2*b*.

When the sampling orders of the first to fourth sample/hold circuits are modified and the switch unit 330 switches between the output terminals of the first and second sample/hold circuit groups 310 and 320 and the data lines data[1] and data[2], the first to fourth sample/hold circuits supply the data currents to the pixels 1*a*, 1*b*, 2*a*, and 2*b* the same number of times. Hence, the average of the output currents of the first to fourth sample/hold circuits is supplied to the respective pixels 1*a*, 1*b*, 2*a*, and 2*b*.

Various embodiments can be formed by modifying the sampling orders of the first to fourth sample/hold circuits, which will be described in reference to third and fourth exemplary embodiments.

Figure 11:
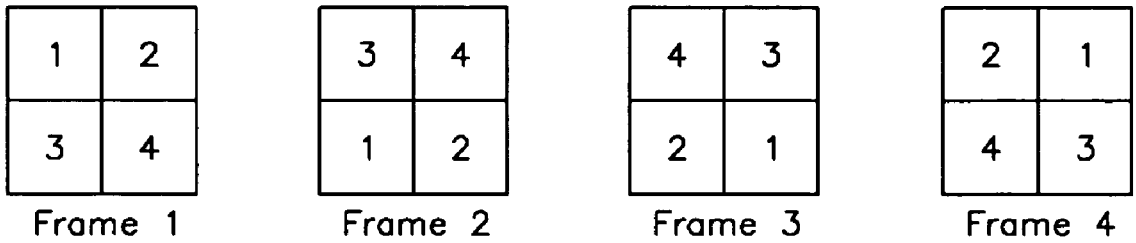
FIG. 11 shows numbers corresponding to sample/hold circuits for supplying currents to pixels according to a third exemplary embodiment of the present invention.
Figure 12A:
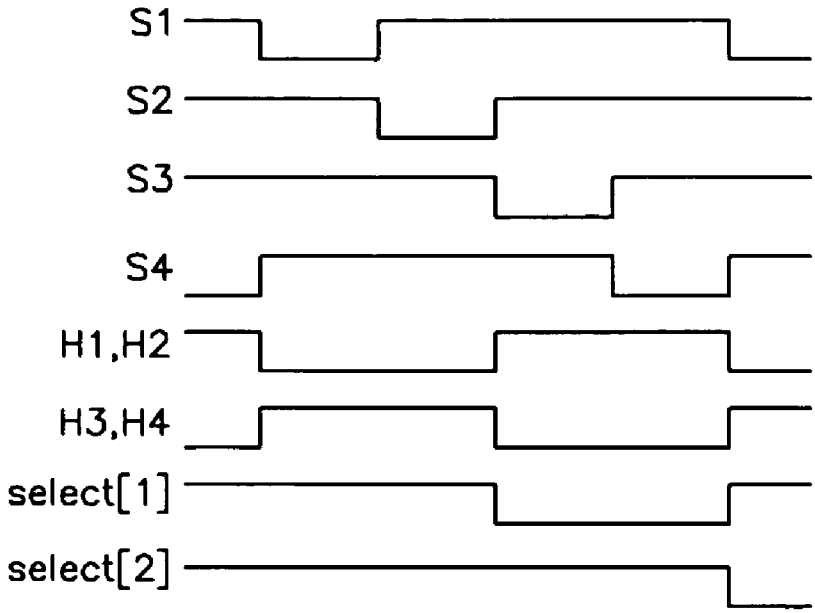
FIGS. 12A to 12D show waveforms of control signals applied to the demultiplexer in the first to fourth frames according to the third exemplary embodiment of the present invention.
Figure 12B:
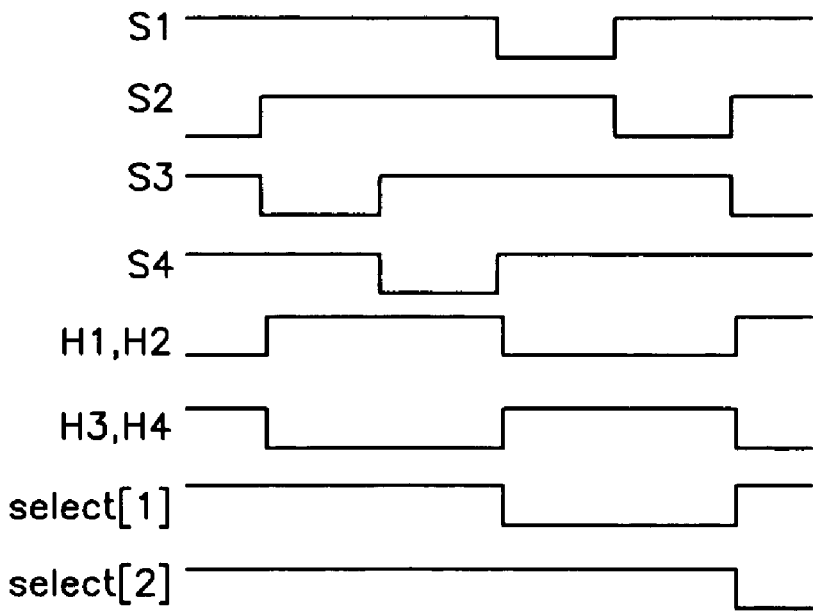
Figure 12C:
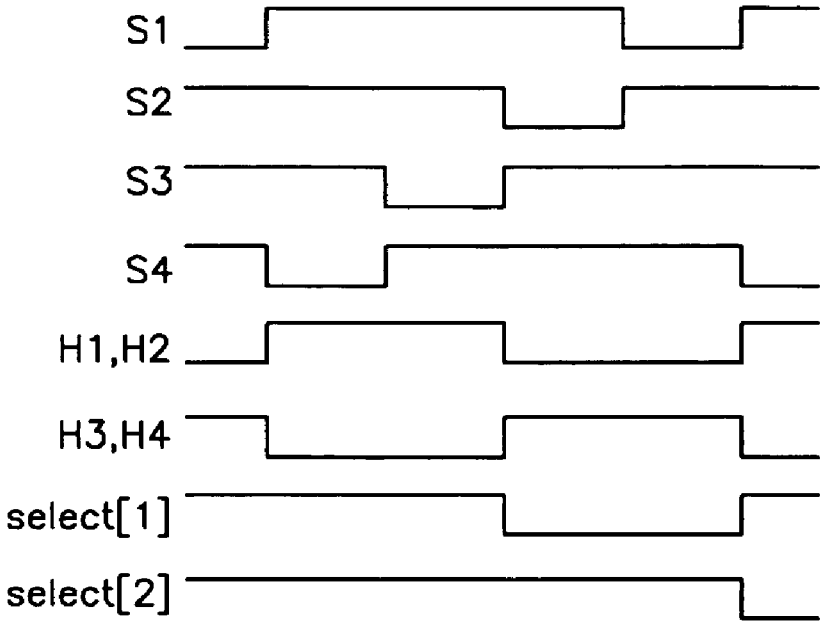
Figure 12D:
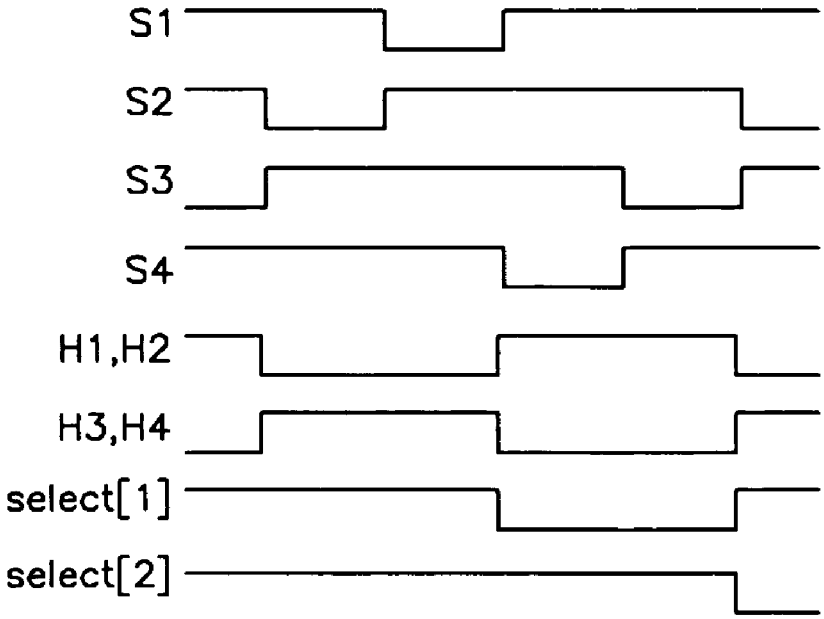
Figure 13:
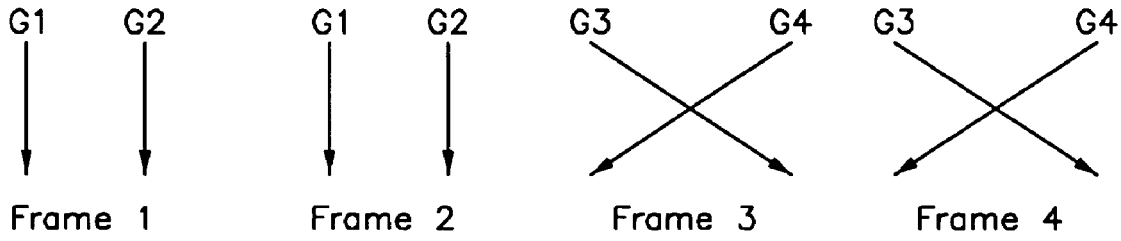
FIG. 13 shows an operation of a switch unit in the first to fourth frames according to the third exemplary embodiment of the present invention.

Referring to FIGS. 11 to 13, an operation of the demultiplexer 700 according to the third exemplary embodiment will be described.

FIG. 11 shows numbers that correspond to the sample/hold circuits for supplying currents to pixels shown in FIG. 7 according to the third exemplary embodiment of the present invention.

FIGS. 12A to 12D show waveforms of control signals applied to the demultiplexer 700 in the first to fourth frames while programming the currents to the pixels 1*a*, 1*b*, 2*a* and 2*b* according to the third exemplary embodiment of the present invention. FIG. 13 shows an operation of the switch unit 330 in the first to fourth frames according to the third exemplary embodiment of the present invention. By way of example, FIG. 13 shows as to which of the switches G1, G2, G3 and G4 of the switch unit 330 are turned on and off for each of the frames.

As the demultiplexer 700 in the first frame of the third exemplary embodiment, as shown in the timing diagram of FIG. 12A, operates in substantially the same manner as it operates in the first frame of the second exemplary embodiment, which is illustrated in FIGS. 8, 9A and 10, FIG. 12A will not be discussed separately.

As shown in FIG. 12B, the sampling switches S3 and S4 are sequentially turned on and the data storage units 33 and 34 sequentially perform a sampling operation in the second frame.

After this, the sampling switches S1 and S2 are sequentially turned on and the data storage units 31 and 32 sequentially perform a sampling operation. At the same time, the select signal Select[1] is applied and the holding switches H3 and H4 are turned on such that the holding currents of the data storage units 33 and 34 are output to the switch unit 330.

As can be from FIGS. 6 and 13, the switch unit 330 transmits the output current of the first sample/hold circuit group 310 to the data line data[1] and transmits the output current of the second sample/hold circuit group 320 to the data line data[2] in the second frame.

Therefore, the holding current of the data storage unit 33 is programmed to the pixel 1*a* through the data line data[1], and the holding current of the data storage unit 34 is programmed to the pixel 1*b* through the data line data[2].

After this, the select signal Select[2] is applied to the pixels 2*a* and 2*b* and the holding switches H1 and H2 are turned on such that the currents which correspond to the data sampled by the data storage units 31 and 32 are respectively held to the data lines data[1] and data[2] through the switch unit 330.

Therefore, the current of the data storage unit 31 is programmed to the pixel 2*a* through the data line data[1], and the current of the data storage unit 34 is programmed to the pixel 2*b* through the data line data[2].

Accordingly, the holding current of the third sample/hold circuit is programmed to the pixel 1*a* of the second frame, the holding current of the fourth sample/hold circuit is programmed to the pixel 1*b*, the holding current of the first sample/hold circuit is programmed to the pixel 2*a*, and the holding current of the second sample/hold circuit is programmed to the pixel 2*b*.

As shown in FIG. 12C, the sampling switches S4 and S3 are sequentially turned on and the data storage units 34 and 33 sequentially sample the data current in the third frame.

After this, the sampling switches S2 and S1 are sequentially turned on and the data storage units 32 and 31 sequentially perform a sampling operation. At the same time, the select signal Select[1] is applied to the pixels 1*a* and 1*b* and the holding switches H3 and H4 are turned on such that the data storage units 33 and 34 hold the currents to the data lines data[1] and data[2] through the switch unit 330.

As can be seen from FIGS. 6 and 13, the switch unit 330 transmits the output current of the first sample/hold circuit group 310 to the data line data[2] and transmits the output current of the second sample/hold circuit group 320 to the data line data[1] in the third frame.

Therefore, the holding current of the data storage unit 33 is programmed to the pixel 1*b* through the data line data[2], and the holding current of the data storage unit 34 is programmed to the pixel 1*a* through the data line data[1].

After this, when the select signal Select[2] is applied, the currents which correspond to the sampled data are output to the data storage units 31 and 32, the holding current of the data storage unit 31 is programmed to the pixel 2*b* by the switch unit 330, and the holding current of the data storage unit 32 is programmed to the pixel 2*a*.

Accordingly, the holding current of the fourth sample/hold circuit is programmed to the pixel 1*a* of the third frame, the holding current of the third sample/hold circuit is programmed to the pixel 1*b*, the holding current of the second sample/hold circuit is programmed to the pixel 2*a*, and the holding current of the first sample/hold circuit is programmed to the pixel 2*b*.

As shown in FIG. 12D, the sampling switches S2 and S1 are sequentially turned on and the data storage units 32 and 31 sequentially perform a sampling operation in the fourth frame.

After this, the sampling switches S4 and S3 are sequentially turned on and the data storage units 34 and 33 sequentially perform a sampling operation. Also, the select signal Select[1] is applied to the pixels 1*a* and 1*b*, and the holding switches H1 and H2 are turned on such that the holding current of the data storage units 31 and 32 are output to the switch unit 330.

As can be seen from FIGS. 6 and 13, the switch unit 330 transmits the output current of the first sample/hold circuit group 310 to the data line data[2] and transmits the output current of the second sample/hold circuit group 320 to the data line data[1] in the fourth frame.

Therefore, the holding current of the data storage unit 31 is programmed to the pixel 1*b* through the data line data[2], and the holding current of the data storage unit 32 is programmed to the pixel 1*a* through the data line data[1].

After this, the select signal Select[2] is applied to the pixels 2*a* and 2*b* and the currents which correspond to the data sampled by the data storage units 33 and 34 are respectively held to the data lines data[2] and data[1] through the switch unit 330. Therefore, the holding current of the data storage unit 34 is programmed to the pixel 2*a*, and the holding current of the data storage unit 33 is programmed to the pixel 2*b*.

Accordingly, the holding current of the second sample/hold circuit is programmed to the pixel 1*a* of the fourth frame, the holding current of the first sample/hold circuit is programmed to the pixel 1*b*, the holding current of the fourth sample/hold circuit is programmed to the pixel 2*a*, and the holding current of the third sample/hold circuit is programmed to the pixel 2*b*.

In the third exemplary embodiment, the numbers corresponding to the sample/hold circuits for providing the currents to the pixels 1*a*, 1*b*, 2*a*, and 2*b* of the first frame are changed up and down in the second frame, the numbers corresponding to the sample/hold circuits of the second frame are changed right and left in the third frame, and the numbers corresponding to the sample/hold circuits of the third frame are changed up and down in the fourth frame. Hence, the first to fourth sample/hold circuits supply the data currents to the pixels 1*a*, 1*b*, 2*a*, and 2*b* the same number of times.

Referring to FIGS. 14 to 16B, an operation of the demultiplexer according to the fourth exemplary embodiment will be described.

Figure 14:
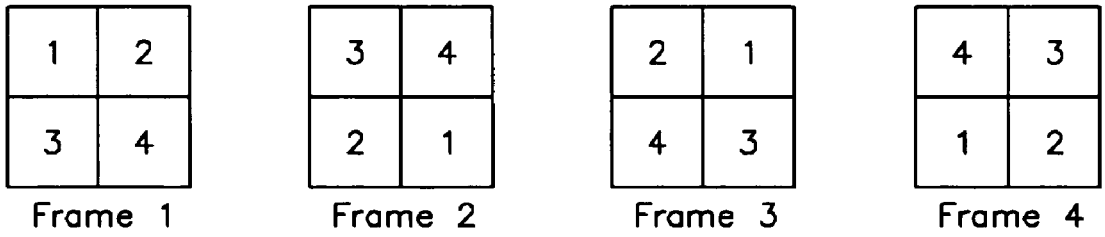
FIG. 14 shows numbers corresponding to sample/hold circuits for supplying currents to pixels according to a fourth exemplary embodiment of the present invention.

FIG. 14 shows numbers corresponding to the sample/hold circuits for programming the currents to the pixels 1*a*, 1*b*, 2*a*, and 2*b* according to the fourth exemplary embodiment of the present invention.

As shown, the first to fourth sample/hold circuits program the current to the pixels 1*a*, 1*b*, 2*a*, and 2*b* in the first frame, and the number of the sample/hold circuits of the whole frames are changed up and down in the second to fourth frames, and the numbers of the sample/hold circuits for programming the currents to the pixel corresponding to the scan line Select[2] are changed right and left.

Figure 15A:
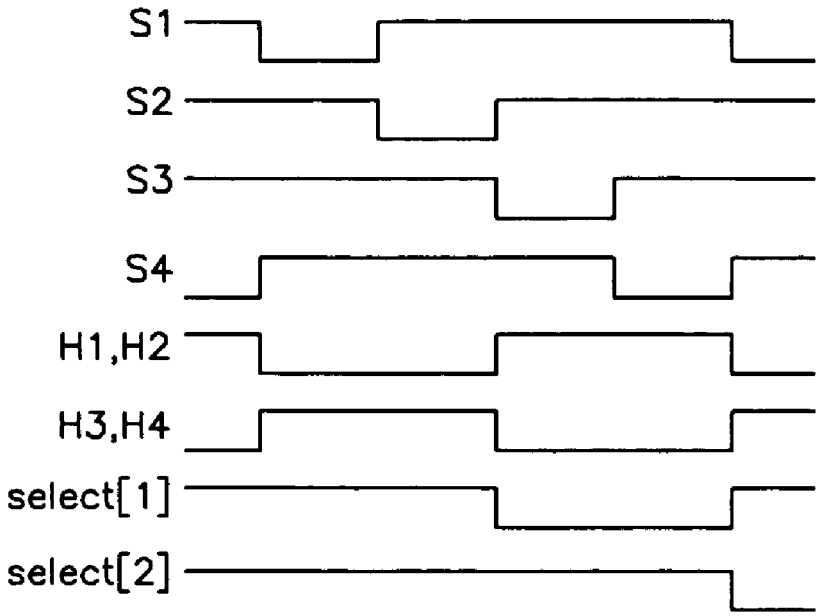
FIGS. 15A to 15D show waveforms of control signals applied to the demultiplexer in the first to fourth frames according to the fourth exemplary embodiment of the present invention.
Figure 15B:
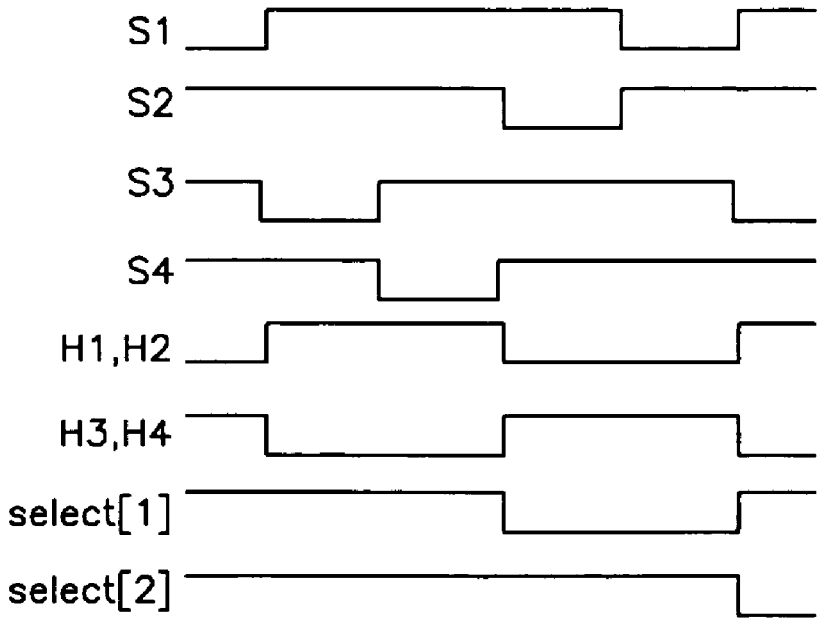
Figure 15C:
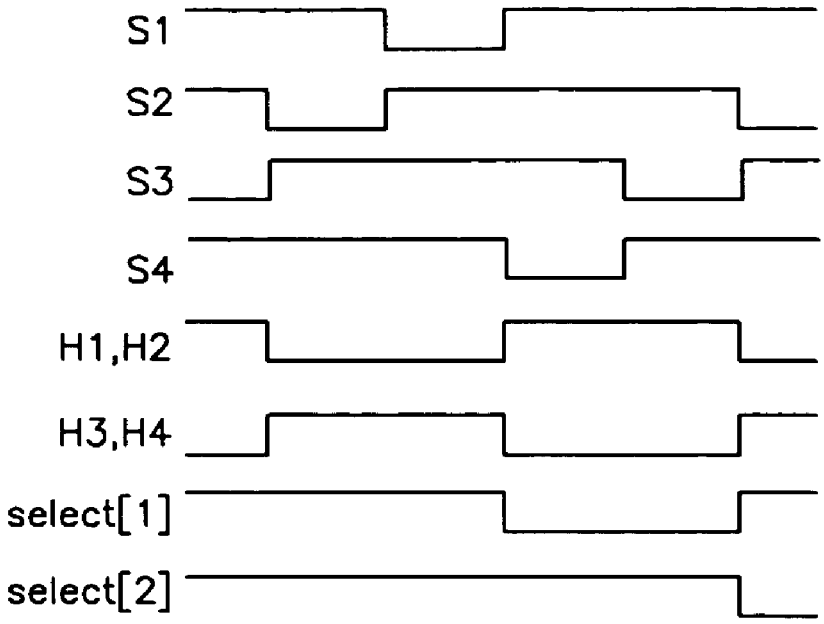
Figure 15D:
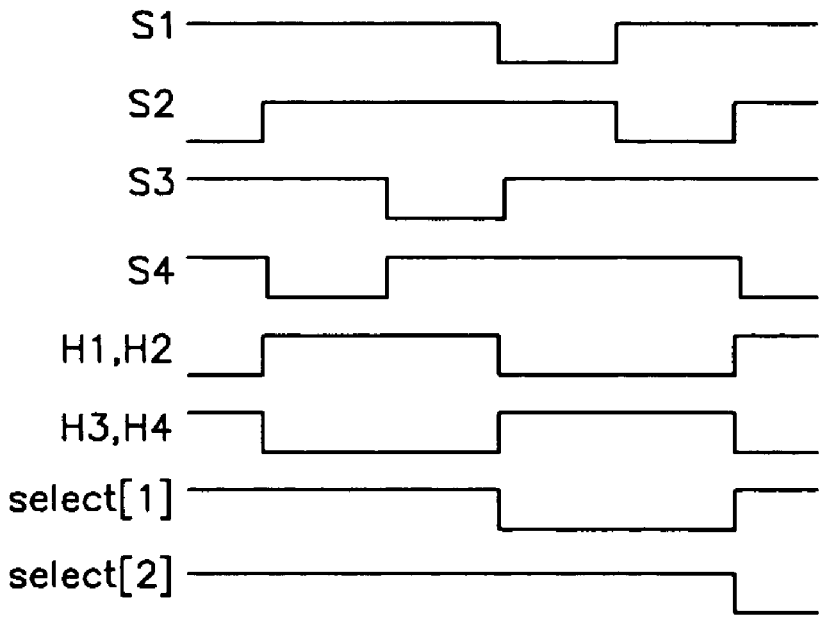
Figure 16A:
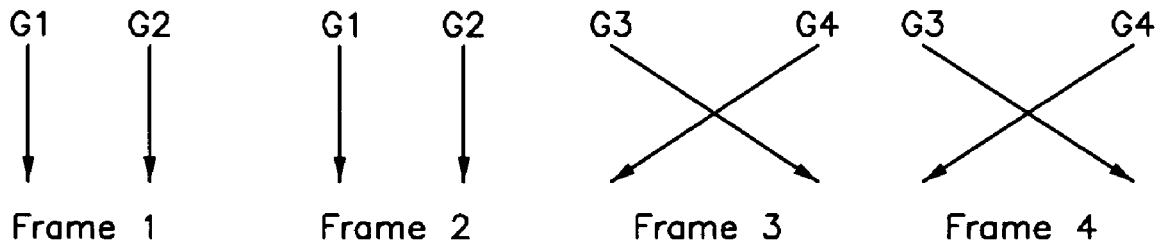
FIGS. 16A and 16B show an operation of a switch unit when an odd scan line and an even scan line are selected respectively according to the fourth exemplary embodiment of the present invention.
Figure 16B:
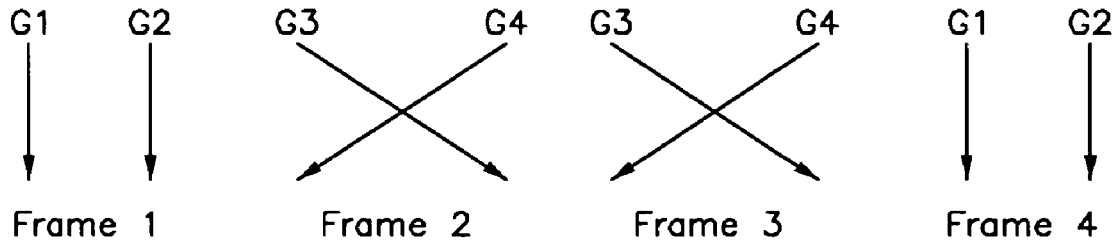

FIGS. 15A to 15D show waveforms of control signals applied to the demultiplexer 700 in the first to fourth frames according to the fourth exemplary embodiment of the present invention, and FIGS. 16A and 16B show an operation of the switch unit 330 when an odd scan line and an even scan line are selected, respectively.

Referring to FIGS. 15A to 16B, an operation of the demultiplexer 700 will be described. The operation of the demultiplexer 700 in the first frame corresponding to the timing diagram of FIG. 15A will not be described separately since it is substantially the same as that of the first frame in the second exemplary embodiment as illustrated in FIG. 9A.

As shown in FIG. 15B, the sampling switches S3, S4, S2, and S1 are sequentially turned on in the second frame.

The data storage units 33 and 34 sequentially perform a sampling operation while the sampling switches S3 and S4 are turned on.

The data storage units 32 and 31 sequentially perform a sampling operation while the sampling switches S2 and S1 are turned on. Also, the select signal Select[1] is applied and the holding switches H3 and H4 are turned on such that the holding currents of the data storage units 33 and 34 are programmed to the data lines data[1] and data[2] through the switch unit 330.

Since the operation of the switch unit 330 of the odd scan line is given in FIG. 16A in the second frame, the holding current of the data storage unit 33 is programmed to the pixel 1*a* through the data line data[1], and the holding current of the data storage unit 34 is programmed to the pixel 1*b* through the data line data[2].

After this, the select signal Select[2] is applied to the pixels 2*a* and 2*b* and the holding switches H1 and H2 are turned on such that the currents which correspond to the data sampled by the data storage units 31 and 32 are respectively held to the data lines data[2] and data[1] through the switch unit 330.

Since the operation of the switch unit 330 of the even scan line is given in FIG. 16B in the second frame, the holding current of the data storage unit 31 is programmed to the pixel 2*b* through the data line data[2], and the holding current of the data storage unit 32 is programmed to the pixel 2*a* through the data line data[1].

Accordingly, the holding current of the third sample/hold circuit is programmed to the pixel 1*a* of the second frame, the holding current of the fourth sample/hold circuit is programmed to the pixel 1*b*, the holding current of the second sample/hold circuit is programmed to the pixel 2*a*, and the holding current of the first sample/hold circuit is programmed to the pixel 2*b*.

As shown in FIG. 15C, the sampling switches S2, S1, S4, and S3 are sequentially turned on in the third frame.

The data storage units 32 and 31 sequentially perform a sampling operation while the sampling switches S2 and S1 are turned on.

The data storage units 34 and 33 sequentially perform a sampling operation while the sampling switches S4 and S3 are turned on. Also, the select signal Select[1] is applied and the holding switches H1 and H2 are turned on such that the holding currents of the data storage units 31 and 32 are programmed to the data lines data[1] and data[2] through the switch unit 330.

Since the operation of the switch unit 330 of the odd scan line is given in FIG. 16A in the third frame, the holding current of the data storage unit 31 is programmed to the pixel 1*b* through the data line data[2], and the holding current of the data storage unit 32 is programmed to the pixel 1*a* through the data line data[1].

After this, the select signal Select[2] is applied to the pixels 2*a* and 2*b* and the holding switches H3 and H4 are turned on such that the currents which correspond to the data sampled by the data storage units 33 and 34 are respectively held to the data lines data[2] and data[1] through the switch unit 330.

Since the operation of the switch unit 330 of the even scan line is given in FIG. 16B in the third frame, the holding current of the data storage unit 33 is programmed to the pixel 2*b* through the data line data[2], and the holding current of the data storage unit 34 is programmed to the pixel 2*a* through the data line data[1].

Accordingly, the holding current of the second sample/hold circuit is programmed to the pixel 1*a* of the third frame, the holding current of the first sample/hold circuit is programmed to the pixel 1*b*, the holding current of the fourth sample/hold circuit is programmed to the pixel 2*a*, and the holding current of the third sample/hold circuit is programmed to the pixel 2*b*.

As shown in FIG. 15D, the sampling switches S4, S3, S1, and S2 are sequentially turned on in the fourth frame.

The data storage units 34 and 33 sequentially perform a sampling operation while the sampling switches S4 and S3 are turned on.

The data storage units 31 and 32 sequentially perform a sampling operation while the sampling switches S1 and S2 are turned on. Also, the select signal Select[1] is applied and the holding switches H3 and H4 are turned on such that the holding currents of the data storage units 33 and 34 are programmed to the data lines data[1] and data[2] through the switch unit 330.

Since the operation of the switch unit 330 of the odd scan line is given in FIG. 16A in the fourth frame, the holding current of the data storage unit 33 is programmed to the pixel 1*b* through the data line data[2], and the holding current of the data storage unit 34 is programmed to the pixel 1*a* through the data line data[1].

After this, the select signal Select[2] is applied to the pixels 2*a* and 2*b* and the holding switches H1 and H2 are turned on such that the currents which correspond to the data sampled by the data storage units 31 and 32 are respectively held to the data lines data[1] and data[2] through the switch unit 330.

Since the operation of the switch unit 330 of the even scan line is given in FIG. 16B in the fourth frame, the holding current of the data storage unit 31 is programmed to the pixel 2*a* through the data line data[1], and the holding current of the data storage unit 32 is programmed to the pixel 2*b* through the data line data[2].

Accordingly, the holding current of the fourth sample/hold circuit is programmed to the pixel 1*a* of the fourth frame, the holding current of the third sample/hold circuit is programmed to the pixel 1*b*, the holding current of the first sample/hold circuit is programmed to the pixel 2*a*, and the holding current of the second sample/hold circuit is programmed to the pixel 2*b*.

By modifying the sampling orders of the first to fourth sample/hold circuits and differently establishing the operations of the switch unit in the odd frame and in the even frame according to the fourth exemplary embodiment, the first to fourth sample/hold circuits supply the data currents to the pixels 1*a*, 1*b*, 2*a*, and 2*b* the same number of times.

The 1:2 demultiplexer has been described for ease of description, but the scope of the present invention is not restricted to this, and various modified 1:N demultiplexers can be realized by using the scope of the present invention.

Also, it is described above that the orders of the first to fourth sample/hold circuits programmed to the pixels per frame are modified, which can be executed per subframe.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A display device including a plurality of data lines comprising a first data line and a second data line, a plurality of scan lines for transmitting select signals, and a plurality of pixel circuits coupled to the data lines and the scan lines, the display device comprising:

a data driver for supplying data currents corresponding to image signals;

a demultiplexer including first and second sample/hold circuit groups having input terminals coupled to the data driver, each said sample/hold circuit group including at least two sample/hold circuits;

a switch unit for switching between output terminals of the first and second sample/hold circuit groups and the data lines; and a scan driver for supplying the select signals to the scan lines, wherein one of the sample/hold circuits of the first sample/hold circuit group samples a corresponding one of the data currents during at least a part of a period in which another one of the sample/hold circuits of the first sample/hold circuit group outputs a current to the switch unit, wherein one of the sample/hold circuits of the second sample/hold circuit group samples a corresponding one of the data currents during at least a part of a period in which another one of the sample/hold circuits of the second sample/hold circuit group outputs a current to the switch unit, and wherein the switch unit is configured to program the current output by the first sample/hold circuit group to the first data line and the current output by the second sample/hold circuit group to the second data line in one frame, and to program the current output by the first sample/hold circuit group to the second data line and the current output by the second sample/hold circuit group to the first data line in another frame.

2. The display device of claim 1, wherein the sample/hold circuits of the first sample/hold circuit group include first and third sample/hold circuits each having an input terminal and an output terminal, wherein the input terminals of the first and third sample/hold circuits are coupled with each other, and the output terminals of the first and third sample/hold circuits are coupled with each other, and wherein the sample/hold circuits of the second sample/hold circuit group include second and fourth sample/hold circuits each having an input terminal and an output terminal, wherein the input terminals of the second and fourth sample/hold circuits are coupled with each other, and the output terminals of the second and fourth sample/hold circuits are coupled with each other.

3. The display device of claim 2, wherein the first and second sample/hold circuits sequentially sample a corresponding one of the data currents during a first period to store as first sampled data, and output currents corresponding to the first sampled data during a second period, and wherein the third and fourth sample/hold circuits sequentially sample a corresponding one of the data currents during the second period to store as second sampled data, and output currents corresponding to the second sampled data during a third period.

4. The display device of claim 3, wherein the first and third periods substantially overlap each other.

5. The display device of claim 4, wherein an operation of the first period is performed before an operation of the second period in one frame, and the operation of the second period is performed before the operation of the first period in another frame.

6. The display device of claim 3, wherein sampling orders of the first and second sample/hold circuits are established differently in at least two different frames.

7. The display device of claim 6, wherein sampling orders of the third and fourth sample/hold circuits are established differently in at least two different frames.

8. The display device of claim 3, wherein the switch unit programs the output currents of the first and second sample/hold circuits to the first and second data lines during the second period, and programs the output currents of the third and fourth sample/hold circuits to the first and second data lines during the third period.

9. The display device of claim 8, wherein operations of the switch unit for the pixel circuits coupled to even ones of the scan lines are different from the operations of the switch unit for the pixel circuits coupled to odd ones of the scan lines.

10. The display device of claim 3, wherein each of the first, second, third and fourth sample/hold circuits comprises:

a data storage unit for sampling the corresponding one of the data currents to store as the sampled data, and holding a current corresponding to the sampled data;

a sampling switch for transmitting the corresponding one of the data currents to the data storage unit in response to a first control signal; and a holding switch for applying the holding current of the data storage unit to the switch unit in response to a second control signal.

11. The display device of claim 2, wherein each of the first, second, third and fourth sample/hold circuits comprises:

a transistor having a first electrode, a second electrode, and a third electrode, and for controlling a current flowing to the third electrode from the second electrode according to a voltage difference between the first and second electrodes;

a first switch for coupling a first power source to the second electrode of the transistor in response to a first control signal;

a second switch for transmitting a corresponding one of the data currents to the first electrode of the transistor in response to a second control signal;

a third switch for diode-connecting the transistor in response to a third control signal;

a capacitor, coupled between the first and second electrodes of the transistor, for storing a voltage corresponding to the corresponding one of the data currents;

a fourth switch for coupling a second power source to the third electrode of the transistor in response to a fourth control signal; and a fifth switch for holding a current corresponding to the voltage stored in the capacitor to the second electrode of the transistor.

12. The display device of claim 11, wherein the first, second and third switches respond to a sampling operation, and the fourth and fifth switches respond to a holding operation.

13. The display device of claim 11, wherein the first, second and third switches are realized with transistors having the same channel type, and the first, second and third control signals are substantially the same as each other.

14. The display device of claim 13, wherein the fourth and fifth switches are realized with transistors having the same channel type, and the fourth and fifth control signals are substantially the same as each other.

15. The display device of claim 1, wherein sampling orders of the currents to be programmed to the pixel circuits are the same on average.

16. A display device including a plurality of data lines comprising a first data line and a second data line, a plurality of scan lines for transmitting select signals, and a plurality of pixel circuits coupled to the data lines and the scan lines, the display device comprising:

a data driver for supplying data currents corresponding to image signals to be displayed during a plurality of frames comprising a first frame and a second frame;

a demultiplexer having an input terminal coupled to the data driver, the demultiplexer for demultiplexing the data currents to output as demultiplexed data currents;

a switch unit for switching between output terminals of the demultiplexer comprising a first output terminal and a second output terminal and the data lines, wherein the switching unit is configured to electrically couple concurrently the first output terminal to the first data line and the second output terminal to the second data line in the first frame and to electrically couple concurrently the first output terminal to the second data line and the second output terminal to the first data line during the second frame; and a scan driver for supplying the select signals to the scan lines.

17. The display device of claim 16, wherein operations of the switch unit are established differently in at least two different frames among the plurality of frames in one period.

18. The display device of claim 15, wherein operations of the switch unit are established differently in at least two different subframes of a frame among the plurality of frames in one period.

19. The display device of claim 16, wherein the demultiplexer comprises:

a first sample/hold circuit group including first and third sample/hold circuits each having an input terminal and an output terminal, wherein the input terminals of the first and third sample/hold circuits are coupled with each other, and the output terminals of the first and third sample/hold circuits are coupled with each other, and a second sample/hold circuit group including second and fourth sample/hold circuits each having an input terminal and an output terminal, wherein the input terminals of the second and fourth sample/hold circuits are coupled with each other, and the output terminals of the second and fourth sample/hold circuits are coupled with each other.

20. The display device of claim 19, wherein the first and second sample/hold circuits sequentially sample a corresponding one of the data currents during a first period to store as first sampled data, and output currents corresponding to the first sampled data during a second period, and wherein the third and fourth sample/hold circuits sequentially sample a corresponding one of the data currents during the second period to store as second sampled data, and output currents corresponding to the second sampled data during a third period.

21. The display device of claim 20, wherein the first and third periods substantially overlap each other.

22. The display device of claim 21, wherein an operation of the first period is performed before an operation of the second period in one frame among the plurality of frames, and the operation of the second period is performed before the operation of the first period in another frame among the plurality of frames.

23. The display device of claim 20, wherein sampling orders of the first, second, third and fourth sample/hold circuits are established differently in at least two different frames among the plurality of frames.

24. The display device of claim 20, wherein sampling orders of the first, second, third and fourth sample/hold circuits are established differently in at least two different subframes of a frame among the plurality of frames.

25. The display device of claim 20, wherein averages of the sample/hold circuits for supplying the currents to the pixel circuits are substantially the same as each other.

26. A display device including a plurality of data lines comprising first and second data lines, a plurality of scan lines for transmitting select signals, and a plurality of pixel circuits coupled to the data lines and the scan lines, the display device comprising:

a data driver for supplying data currents corresponding to image signals;

a demultiplexer including first and second sample/hold circuit groups each having an input terminal coupled to the data driver, and configured for demultiplexing the data currents to output as demultiplexed data currents;

a switch unit for switching between output terminals of the first and second sample/hold circuit groups and the data lines; and a scan driver for supplying the select signals to the scan lines, wherein the first sample/hold circuit group includes first and third sample/hold circuits each having an input terminal and an output terminal, wherein the input terminals of the first and third sample/hold circuits are coupled with each other, and the output terminals of the first and third sample/hold circuits are coupled with each other, wherein the second sample/hold circuit group includes second and fourth sample/hold circuits, each having an input terminal and an output terminal, wherein the input terminals of the second and fourth sample/hold circuits are coupled with each other, and the output terminals of the second and fourth sample/hold circuits are coupled with each other, and wherein the first and second sample/hold circuit groups are configured such that the first sample/hold circuit supplies a corresponding one of the demultiplexed data currents to the first data line while the second sample/hold circuit supplies a corresponding one of the demultiplexed data currents to the second data line during a first frame, and the third sample/hold circuit supplies a corresponding one of the demultiplexed data currents to the second data line while the fourth sample/hold circuit supplies a corresponding one of the demultiplexed data currents to the first data line during a second frame.

27. The display device of claim 26, wherein the first and second sample/hold circuits sequentially sample a corresponding one of the data currents during a first period to store as first sampled data, and output currents corresponding to the first sampled data during a second period, and wherein the third and fourth sample/hold circuits sequentially sample a corresponding one of the data currents during the second period to store as second sampled data, and output currents corresponding to the second sampled data during a third period.

28. The display device of claim 27, wherein the first and third periods substantially overlap each other.

29. A demultiplexer for programming a time-divided data current, which is input by a data driver, to a first signal line and a second signal line, comprising:

first and second sample/hold circuit groups each having an input terminal coupled to a data driver, and configured for demultiplexing the data current to output as demultiplexed data currents; and a switch unit for switching between output terminals of the first and second sample/hold circuit groups and the first and second signal lines, wherein the first sample/hold circuit group includes first and third sample/hold circuits each having an input terminal and an output terminal, wherein the input terminals of the first and third sample/hold circuits are coupled with each other, and the output terminals of the first and third sample/hold circuits are coupled with each other, wherein the second sample/hold circuit group includes second and fourth sample/hold circuits each having an input terminal and an output terminal, wherein the input terminals of the second and fourth sample/hold circuits are coupled with each other, and the output terminals of the second and fourth sample/hold circuits are coupled with each other, and wherein the first and second sample/hold circuit groups are configured such that the first sample/hold circuit supplies a corresponding one of the demultiplexed data currents to the first signal line while the second sample/hold circuit supplies a corresponding one of the demultiplexed data currents to the second signal line during a first time period, and the third sample/hold circuit supplies a corresponding one of the demultiplexed data currents to the second signal line while the fourth sample/hold circuit supplies a corresponding one of the demultiplexed data currents to the first signal line during a second time period.

30. The demultiplexer of claim 29, wherein the first and second sample/hold circuits sequentially sample a corresponding one of the data currents to store as first sampled data during a first period, and output currents corresponding to the first sampled data during a second period, and wherein the third and fourth sample/hold circuits sequentially sample a corresponding one of the data currents to store as second sampled data during the second period, and output currents corresponding to the second sampled data during a third period.

31. The demultiplexer of claim 30, wherein the first and third periods substantially overlap each other.

32. A demultiplexing method for outputting a time-divided and sequentially input data current to a first signal line and a second signal line, comprising:

allowing first and second sample/hold circuits to sequentially sample the data current to store as first sampled data in a predetermined order during a first period;

allowing the first and second sample/hold circuits to hold a current corresponding to the first sampled data to the signal lines during a second period;

allowing third and fourth sample/hold circuits to sample the data current to store as second sampled data during the second period; and allowing the third and fourth sample/hold circuits to hold a current corresponding to the second sampled data to the signal lines during a third period, wherein the sample/hold circuits are configured such that one of first and second sample/hold circuits supplies the first sampled data to the first signal line while one of third and fourth sample/hold circuits supplies the second sampled data to the second signal line, and the other one of the first and second sample/hold circuits supplies the first sampled data to the second signal line while the other one of the third and fourth sample/hold circuits supplies the second sampled data to the first signal line.

33. The demultiplexing method of claim 32, wherein sampling orders of the first, second, third and fourth sample/hold circuits are different in at least two different frames.

34. The demultiplexing method of claim 32, wherein sampling orders of the first, second, third and fourth sample/hold circuits are different in at least two different subframes.

35. The demultiplexing method of claim 32, wherein orders for the first, second, third and fourth sample/hold circuits to sample the data current are substantially the same as each other on average.

* * * * *

UNITED STATES PATENT AND TRADEMARK OFFICE

CERTIFICATE OF CORRECTION

PATENT NO. : 7,605,810 B2
APPLICATION NO. : 10/972276
DATED : October 20, 2009
INVENTOR(S) : Dong-Yong Shin et al.

It is certified that error appears in the above-identified patent and that said Letters Patent is hereby corrected as shown below:

In the Claims

Column 16, Claim 18, line 25 Delete "15" Insert -- 16 --

Signed and Sealed this
Eighth Day of February, 2011

David J. Kappos

David J. Kappos
*Director of the United States Patent and Trademark Office*